US005795002A

United States Patent [19]

Boron

[11] Patent Number: 5,795,002

[45] Date of Patent: Aug. 18, 1998

[54] GRIPPING DEVICE

[75] Inventor: Robert A. Boron, Chicago, Ill.

[73] Assignee: Inventionworks, Inc., Chicago, Ill.

[21] Appl. No.: 711,247

[22] Filed: Sep. 10, 1996

[51] Int. Cl.[6] ..... B25B 9/02

[52] U.S. Cl. ..... 294/99.2; 294/3; 294/902

[58] Field of Search ..... 294/1.3, 1.4, 3, 294/7, 8, 8.5, 16, 33, 99.2, 118, 902; 100/234, 116, 211, 296, 297; 43/7, 11, 12; 210/465, 470, 471

[56] References Cited

U.S. PATENT DOCUMENTS

| | | | |
|---|---|---|---|
| 1,019,967 | 3/1912 | King | 210/471 |
| 2,559,978 | 7/1951 | Marco | 294/118 |
| 2,673,649 | 3/1954 | Bass, Sr. | 210/471 |
| 2,929,166 | 3/1960 | Sneide | 294/99.2 |
| 4,063,380 | 12/1977 | Grim | 43/11 |
| 4,330,936 | 5/1982 | Swarth | 294/99.2 |
| 4,822,487 | 4/1989 | Soich | 210/470 |
| 4,905,870 | 3/1990 | Mamolou | 294/99.2 |
| 4,986,586 | 1/1991 | Eilrich et al. | 294/99.2 |
| 5,249,389 | 10/1993 | Gallo | 294/99.2 |
| 5,342,513 | 8/1994 | Wall et al. | 43/11 |
| 5,536,107 | 7/1996 | Baker | 210/470 |

*Primary Examiner*—Dean Kramer
*Attorney, Agent, or Firm*—Dick and Harris

[57] ABSTRACT

An article-holding device for releasably grasping and retaining a substantially solid and/or irregularly-shaped object comprising at least one handle member having a proximal end, a distal end, and a gripping region, the gripping region further comprising an elastomeric region for grasping and retaining substantially solid and/or irregularly-shaped objects. The elastomeric region of the preferred embodiment includes a frame portion and a substantially open portion, with a substantially taut sheet member extending across at least a portion of the substantially open portion.

15 Claims, 1 Drawing Sheet

GRIPPING DEVICE

BACKGROUND OF THE INVENTION

The present invention is directed to article-holding devices for moving substantially solid objects. In particular, the present invention is directed to article-holding devices for moving irregularly-shaped objects, for moving sturdy objects, such as manufactured articles or parts, as well as for moving fragile objects, such as food products, ice, Jello®, etc.

In order to facilitate the moving of irregularly-shaped and sturdy objects, as well as fragile objects, the present invention includes an elastomeric region incorporated in the gripping means for reducing the stress associated with the gripping means. This elastomeric region prevents "marking" of objects, as well as breaking of fragile objects due to high concentrations of stress at the gripping point, while still allowing for retaining these objects securely.

Bifurcated, biased article-holding devices, such as ice tongs, for moving objects that are made of plastic, metal or other biasable material, are well-known in the art. While such devices may provide for relatively easy grasping and moving of objects, if it is desired to move a fragile object without breaking it, or to move a substantially solid object without "marking" it, or to move an irregularly-shaped object, it may be difficult to accomplish these tasks using devices well-known in the art.

It would be desirable to provide an elastomeric member to reduce and absorb the stress associated with the grasping and moving of irregularly-shaped or substantially solid objects, such elastomeric member would be operably connected to the gripping means of an article-holding device. Such elastomeric member also ensures the secure handling of the solid, fragile or irregularly-shaped object by, in essence, "capturing" the object rather than relying on relatively small points of contact with the object by the customary devices.

These and other objects of the invention will become apparent in light of the present specification, claims and drawings.

SUMMARY OF THE INVENTION

The present invention is a device for releasably grasping and retaining substantially solid and/or irregularly-shaped objects. The article-holding device comprises at least one handle member having a proximal end and a distal end, with a gripping mechanism associated with the distal end of the handle member. The gripping mechanism includes at least one elastomeric region for grasping and retaining substantially solid and/or irregularly-shaped objects.

DETAILED DESCRIPTION OF THE DRAWINGS

Figure 1:
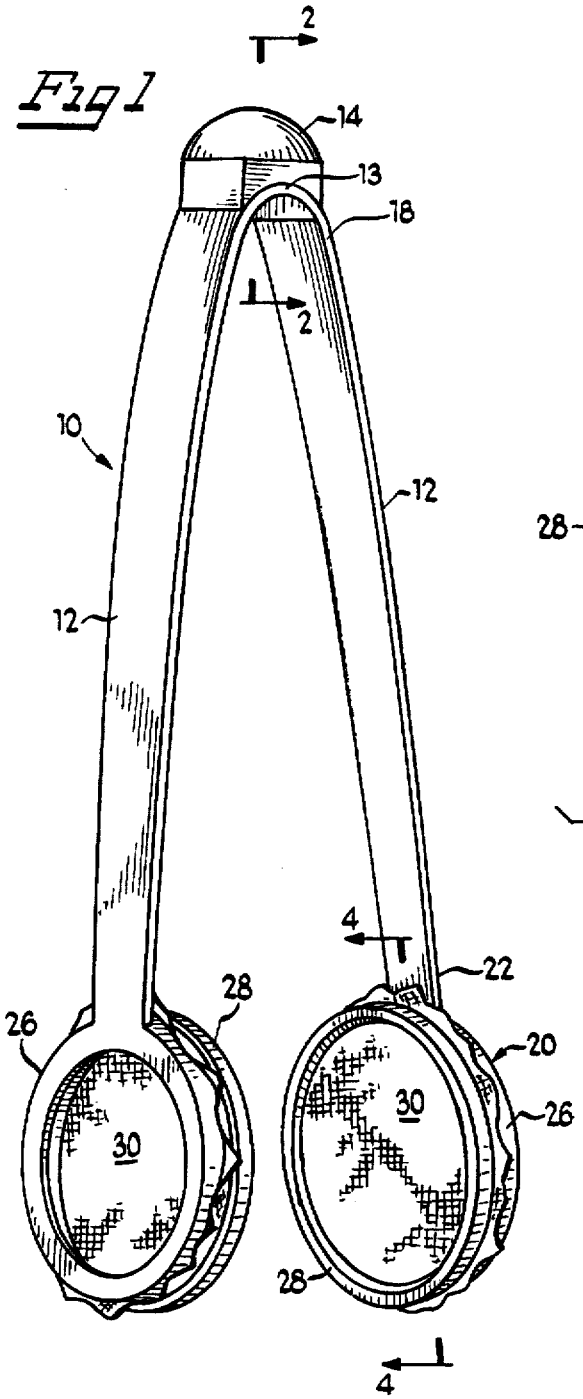
FIG. 1 is a perspective view of an article-holding device according to the present invention.

While the present invention is susceptible of embodiment in many different forms, there is shown in the drawings and will be described herein in detail, specific embodiments, with the understanding that the present disclosure is to be considered as an exemplification of the principles of the invention, and is not intended to limit the invention to the embodiments illustrated.

FIG. 1 shows an article-holding device 10 employing a plurality of handle members 12 connected by a region 13 adjacent protective member 14. The article-holding device 10 may be different sizes—small for objects such as ice cubes or large for objects such as manufacturing parts. The region 13 may be semi-circular, or any other shape that allows the handle members 12 to be maintained in a biasable position relative to each other. The handle members 12 can be made of plastic, metal or any other biasable material. The handle members 12 consist of a proximal end 18 and a distal end 22. As shown in the perspective view of FIG. 1, the handle members 12 may be wider at the proximal end 18 than at the distal end 22, or the handle members 12 may be wider at the distal end 22 than at the proximal end 18. The handle members 12 may also vary in thickness from the proximal end 18 to the distal end 22, or the handle members 12 may be of uniform thickness throughout.

Figure 2:
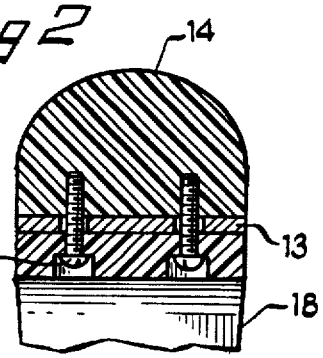
FIG. 2 is a cross-sectional view, taken generally about lines 2—2 of FIG. 1, showing the protective member according to the present invention.

As shown in the cross-sectional view of FIG. 2, the protective member 14 may include at least one bolt 16 for maintaining the handle members 12 in a biased position, although the protective member 14 may maintain the handle members 12 in a biased position via other secured fasteners, fittings, etc. Bolt 16 is optional. Protective member 14 is positioned adjacent to proximal end 18 of each handle member. Protective member 14 is optional. Protective member 14 can be used to break apart items which are stuck together, such as ice cubes.

Figure 3:
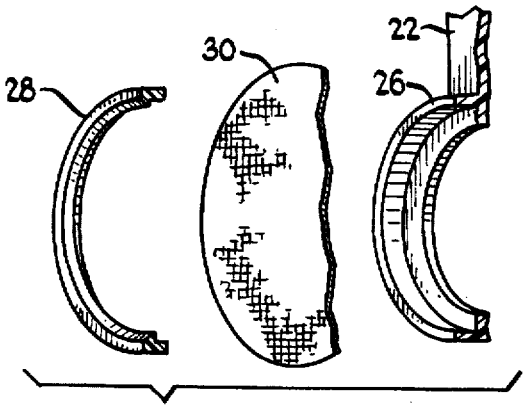
FIG. 3 is a fragmented-exploded view showing the gripping means according to the present invention.

Gripping means 20 are attached to the handle members 12 at the distal end 22 of the handle members 12. The gripping means 20 includes a first frame member 26 and a second frame member 28, which are both substantially circular in the preferred embodiment. As shown in the fragmented-exploded view of FIG. 3, the gripping means 20 further includes an elastomeric region 30 positioned adjacent the first frame member 26 and the second frame member 28. The elastomeric region 30 may be comprised of Spandex®, neoprine rubber, nylon, elastic, netting or foam.

Figure 4:
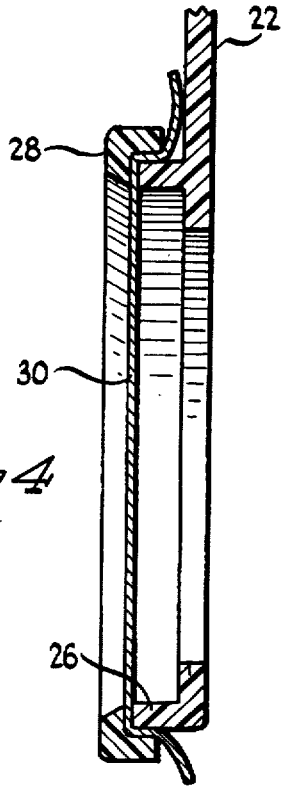
FIG. 4 is a cross-sectional view, taken generally about lines 4—4 of FIG. 1, showing the attachment means according to the present invention.

As illustrated in the cross-sectional view of FIG. 4, the gripping means 20 includes a means for attaching the first frame member 26 and the second frame member 28. In addition, the gripping means 20 holds a portion of the elastomeric region 30 between the first frame member 26 and the second frame member 28. Attaching the first frame member 26 and the second frame member 28 can be accomplished in various ways. For instance, the first frame member 26 and the second frame member 28 may be snap-fitted together, surrounding at least a portion of the elastomeric region 30. The first frame member 26 and the second frame member 28 may also be attached by friction fit or press fit, surrounding at least a portion of the elastomeric region 30. Moreover, the attachment means may be a hook and loop fastener, such as Velcro®, or an adhesive fit, such as glue or tape, used to surround at least a portion of the elastomeric region 30. Furthermore, the first frame member 26 and the second frame member 28 may be attached by spot or resistance welding, soldering or brazing, also used to surround at least a portion of the elastomeric region 30.

Figure 5:
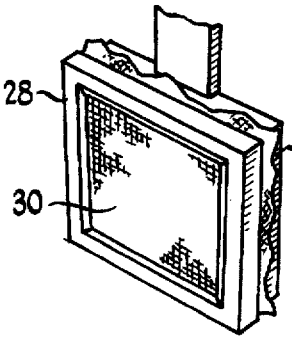
FIG. 5 is a perspective view of an alternative embodiment of the gripping means according to the present invention.

FIG. 5 shows an alternative embodiment of the present invention wherein the first frame member 26 and the second frame member 28 are substantially rectangular. In this alternative embodiment, the first frame member 26 and the second frame member 28 can be attached in the same ways as disclosed above where the first frame member 26 and the second frame member 28 are substantially circular.

I claim:

1. An article-holding device for releasably grasping and retaining a substantially solid and/or irregularly-shaped object, said article-holding device comprising:

at least one handle member having a proximal end and a distal end;

gripping means operably associated with said distal end of said at least one handle member, said gripping means including at least one elastomeric region for grasping and retaining said substantially solid and/or irregularly-shaped object;

said elastomeric region including a frame means having a frame portion, a top portion, and a substantially open portion;

said elastomeric region further including a substantially taut sheet member extending substantially across at least a portion of said substantially open portion substantially proximate said top portion of frame means; and said sheet member being of material sufficiently resilient to substantially and elastically confrom to the shape of the object to be grasped and retained by said device.

2. The device according to claim 1 wherein said at least one elastomeric region includes a first side and a second side opposite said first side, said frame means further comprising:

a first frame member operably associated with said distal end of said at least one handle member and positioned adjacent said first side of said elastomeric region;

a second frame member positioned adjacent said second side of said elastomeric region; and means for attaching said first frame member to said second frame member, to, in turn, releasably hold at least a portion of said elastomeric region in taut engagement therebetween.

3. The device according to claim 2 wherein said first frame member and said second frame member are substantially circular.

4. The device according to claim 2 wherein said first frame member and said second frame member are substantially rectangular.

5. The device according to claim 2 wherein said elastomeric region is stretched substantially uniformly taut about said first frame member.

6. The device according to claim 2 wherein said elastomeric region is stretched substantially uniformly taut about said second frame member.

7. The device according to claim 1 wherein said sheet member comprises a sheet of any one of the following: Spandex®, neoprine rubber, nylon, elastic, netting and foam.

8. The device according to claim 1 having a first and a second handle member wherein:

said proximal end of said first handle member is operably associated with said proximal end of said second handle member; and said gripping means operably associated with at least one of said distal end of said first handle member and said distal end of said second handle member.

9. The device according to claim 8 wherein said proximal end of said first and said second handle member further includes a protective member.

10. The device according to claim 1 having a first and a second handle member wherein:

said proximal end of said first handle member is operably associated with said proximal end of said second handle member; and said gripping means operably associated with said distal end of said first handle member and said distal end of said second handle member.

11. The device according to claim 1 wherein said proximal end of said at least one handle member further includes a protective member for protecting said proximal end, to, in turn, prevent damage to said proximal end of said at least one handle member.

12. An article-holding device for releasably grasping and retaining a substantially solid and/or irregularly-shaped object, said article-holding device comprising:

at least one handle member having a proximal end and a distal end;

gripping means operably associated with said distal end of said at least one handle member, said gripping means including at least one elastomeric region for grasping and retaining said substantially solid and/or irregularly-shaped object;

said elastomeric region including a frame means having a frame portion and a substantially open portion;

said elastomeric region further including a substantially taut sheet member extending across said substantially open portion;

said at least one handle member further comprising a first and second handle member wherein said proximal end of said first handle member is operably associated with said proximal end of said second handle member; and said gripping means is operably associated with at least one of said distal end of said first handle member and said distal end of said second handle member.

13. The device according to claim 12 wherein said gripping means is operably associated with said distal end of said first handle member and said distal end of said second handle member.

14. The device according to claim 13 wherein said proximal end of said at least one handle member further includes a protection member for protection said proximal end, to, in turn, prevent damage to said proximal end of said at least one handle member.

15. The device according to claim 12 wherein said proximal end of said first and said second handle member further includes a protective member.

* * * * *